US005440774A

United States Patent [19]

Cole

[11] Patent Number: 5,440,774

[45] Date of Patent: Aug. 15, 1995

[54] DISPOSABLE INDIVIDUAL GELLED INSTANT TOOTHBRUSH AND SEALED BRUSH POD THEREFOR

[76] Inventor: William L. Cole, 1015 Canter Rd., Atlanta, Ga. 30324

[21] Appl. No.: 272,055

[22] Filed: Jul. 8, 1994

Related U.S. Application Data

[63] Continuation-in-part of Ser. No. 130,890, Oct. 4, 1993, Pat. No. 5,348,153, which is a continuation-in-part of Ser. No. 936,941, Aug. 28, 1992, abandoned.

[51] Int. Cl.[6] ..... A47K 7/02

[52] U.S. Cl. ..... 15/105; 15/167.1; 15/227; 206/63.5; 206/362.2; 2/21

[58] Field of Search ..... 15/184, 104.93, 104.94, 15/227, 106; 206/63.5, 368, 369, 361, 362.2; 2/21; 128/842, 844, 918, 880; 401/7, 268; 602/63

[56] References Cited

U.S. PATENT DOCUMENTS

| | | | |
|---|---|---|---|
| 1,896,941 | 2/1933 | Cohen | 15/227 |
| 2,121,701 | 6/1938 | Landers | 15/227 |
| 2,363,647 | 11/1944 | Cosin | 15/184 |
| 2,763,885 | 9/1956 | Lyons | 15/227 |
| 2,915,767 | 12/1959 | Vaughan | 15/227 |
| 3,070,102 | 12/1962 | MacDonald | 206/361 |
| 3,298,507 | 1/1967 | Micciche | 15/104.94 |
| 3,368,688 | 2/1968 | Micciche | 15/277 |
| 3,806,260 | 4/1974 | Miller | 15/104.94 |
| 4,617,694 | 10/1986 | Bori | 15/227 |
| 5,068,941 | 12/1991 | Dunn | 15/227 |
| 5,107,562 | 4/1992 | Dunn | 15/227 |
| 5,111,934 | 5/1992 | Morin | 15/104.94 |

FOREIGN PATENT DOCUMENTS

| | | | |
|---|---|---|---|
| 291284 | 11/1988 | European Pat. Off. | 15/104.94 |
| 588587 | 5/1925 | France | 15/184 |
| 2446618 | 9/1980 | France | 15/227 |

*Primary Examiner*—David A. Scherbel
*Assistant Examiner*—Tony G. Soohoo
*Attorney, Agent, or Firm*—Hopkins & Thomas

[57] ABSTRACT

A disposable teeth cleaning kit includes a finger mounted toothbrush having a substantially cylindrical elastic sheath with a closed end and an open end. The sheath can be provided with internal longitudinal torque ridges to prevent rolling of the sheath during use. Brush means is disposed on the sheath adjacent its closed end and the sheath is adapted to be furled into a compact configuration wherein the furled portion forms a substantially annular rim bounding an area spanned by the closed end portion of the sheath and the brush means. The brush means is sized and configured to be surrounded and protected by the rim during storage and can be sealed in a protective sterile pod if desired. A sealed brush pod for attachment to an elastic sheath to form a finger mounted toothbrush comprises a base pad from which a bed of brush material projects. The bed of brush material is smaller than the pad to define a peripheral lip of the pad. A plastic protective cover is releasably sealed about the lip and covers and protects the bed of brush material. The protective cover is contoured about its perimeter for receiving and holding a coiled length of dental floss.

12 Claims, 5 Drawing Sheets

DISPOSABLE INDIVIDUAL GELLED INSTANT TOOTHBRUSH AND SEALED BRUSH POD THEREFOR

REFERENCE TO RELATED APPLICATION

This application is a continuation-in-part of patent application Ser. No. 08/130,890 filed Oct. 4, 1993 now U.S. Pat No. 5,348,153, which, in turn, is a continuation-in-part of U.S. patent application Ser. No. 07/936,941 filed on Aug. 28, 1992 now abandoned.

TECHNICAL FIELD

This invention relates generally to dental hygiene and more particularly to single use disposable toothbrushes and teeth cleaning kits incorporating such brushes as well as to seald brush pods for use in fabricating such brushes.

BACKGROUND OF THE INVENTION

A complete and successful regiment of oral hygiene and the care of one's teeth necessarily includes brushing the teeth after every meal and sometimes after snacks, coffee, tea, and the like. Unfortunately, strict adherence to such a regiment is often difficult when using conventional toothbrushes and toothpastes since these articles are traditionally too large, bulky, and potentially messy to carry in one's pocket or purse. The problem is particularly acute for airline passengers, who would like to brush their teeth after having a meal on the plane, and for hikers or backpackers for whom each unnecessary ounce of added weight and bulk in their pack can be critical. Also, it is usually desirable for parents that children brush their teeth after meals at school, at play, and in restaurants. However, it is virtually impossible to convince children to carry with them a conventional toothbrush and toothpaste for such purpose.

A number of attempts have been made in the past to provide compact disposable toothbrushes that can be carried in a purse or pocket and discarded after having been used to brush the teeth. U.S. Pat. No. 5,068,941 of Dunn, for example, shows a thimble-like structure that fits on the end of a finger and that has a multitude of protruding bristles that function to brush and clean the teeth as the tip of the finger is moved with a brushing motion across the teeth. This patent also discloses a second embodiment wherein a sheath fits on the finger, has bristles on the end, and, for storage, folds up and over itself to form a compact self-enclosing package. U.S. Pat. No. 4,679,274 of Friedman discloses a device having a brush with conventional bristles mounted to a plastic frame that clips onto the tip of a user's finger. U.S. Pat. No. 4,617,694 of Bori shows a similar device wherein a plastic clip for the fingertip has a unique bristle design protruding therefrom for brushing the teeth. U.S. Pat. Nos. 5,107,562 of Dunn, 1,896,941 of Cohen, and 4,620,528 of Arraval also disclose various types of toothbrushing devices that are mounted on one's finger and that, in most cases, are disposable after use.

While the devices disclosed in the above referenced patents represent improvements over traditional brushes and toothpaste for brushing the teeth while traveling or while at the office or at school, they nevertheless tend to be plagued with certain problems and shortcomings inherent in their respective designs. For example, devices that include a rigid clip that mounts to the end of a finger generally are bulky, cumbersome, and difficult to manufacture. Further, these devices still require that a dentifrice, such as toothpaste, be carried separately and applied to the brush before use. Finger mounted devices that fold over themselves to form a self-enclosing pouch tend to be inefficient to produce since each item must be manipulated to fold and seal it during the manufacturing progress. Furthermore, any tooth paste or other dentifrice applied to the bristles of these devices tends to become smeared onto the pouch forming portion of the device creating a mess when the device is unfolded and placed on the finger.

Finger mounted toothbrushes that have taken the form of a rollable latex finger cot that can be unrolled onto a finger have also been plagued with their problems. For example, the brush portions of such devices tend to be exposed to compressive forces on the device that can smash or deform the bristles of the brush. This can be a particular problem for these finger cot type brushes since they are designed to roll up onto a relatively flat configuration and are stored in a pouch that is kept in a pocket, purse, or backpack where significant compressive forces are common. Many of these devices become useless after periods of such storage because the bristles of the brush get flattened and pre-applied dentifrice can simply become smeared on the inside of the storage pouch. In addition, brushes of the finger cot variety have tended to slip around on the finger during use. Furthermore, there has been no effective way of insuring a sterile condition of the brush and dentifrice before use. Finally, while the brushes of these various devices tend to clean the exposed clinical crowns of one's teeth, there generally is no provision for cleaning interproximally between the teeth.

Therefore, a continuing and heretofore unaddressed need exists for a compact teeth cleaning kit that can be carried easily in a purse or pocket, that incorporates a disposable finger mounted toothbrush that is economical to fabricate, forms a tight compact configuration for storage that is easily placed on the finger for use, that incorporates means for cleaning between the teeth as well as brushing the surface of the teeth, that provides protection against brush flattening and deformation as a result of compressive forces, that insures a sterile condition for the brush and dentifrice impregnated thereon, and that is efficient, inexpensive, and easy to produce. It is to the provision of such a teeth cleaning kit and disposable brush that the present invention is primarily directed.

SUMMARY OF THE INVENTION

The present invention is a compact disposable teeth cleaning kit that can be carried easily in a purse or pocket, kept in a desk drawer, or carried in a backpack. The kit includes a disposable finger mounted toothbrush comprising a substantially cylindrical elastic sheath having an open end and a closed end. The sheath is adapted to be rolled up or furled from its open end toward its closed end into a compact storage configuration wherein the furled portion of the sheath forms a substantially annular peripheral rim with the end portion of the sheath spanning the area encircled by the rim. Preferably, the sheath is formed with longitudinally extending torque ridges that extend along the length of the sheath on at least the inside surface thereof. These ridges help insure that, once rolled onto a finger, the sheath does not tend to slip around on the finger during use of the brush.

The end portion of the sheath is provided with brush means such as, for example, protruding bristles, that is adapted to clean the teeth of a user when applied with a brushing motion thereto. Preferably, the brush means is covered and protected on the sheath by a removable plastic cap that forms a sealed sterile cover for the brush. This cover further protects the bristles of the brush during storage and insures a sterile condition for the brush and any dentifrice pre-impregnated thereon until the moment of use. At use, the cover is simply peeled away and discarded or recycled.

The brush and its protective cover are sized and positioned on the sheath so that when the sheath is furled into its storage configuration, the brush and cover become surrounded by the furled rim of the sheath. Further, the brush and cover are formed to have a thickness that is less than that of the furled rim. In this way, the brush is protected against compressive forces since such forces are borne by the furled rim and not the brush. Thus, the bristles of the brush do not become crushed and the dentifrice remains intact.

The sheath is sized and configured to be unfurled onto and fit snugly about a user's finger with the closed end of the sheath positioned adjacent the tip of the finger and the open end of the sheath positioned adjacent the base of the finger. When unfurled onto the finger in this way, the brush means is disposed adjacent to the tip of the finger so that it can be applied conveniently to the user's teeth with a brushing motion upon appropriate manipulation of the finger. During such use, the torque ridges on the inside of the sheath grip the finger to prevent the sheath from rolling or slipping around on the finger. Preferably, the brush means is impregnated with a dentifrice such as a tooth paste or gel to aid in the cleaning of the teeth as they are brushed. For use, the protective cover is simply peeled away and discarded whereupon the teeth can be brushed in the usual way.

Once the teeth have been brushed and cleaned, the toothbrush of this invention is simply unfurled to remove it from the user's finger whereupon the brush is simply discarded in an appropriate refuse receptacle such as a garbage can. The kit also includes a foil or other appropriate pouch in which the disposable toothbrush is sealed for carrying and storage prior to use. A length of dental floss is sealed within the pouch with the disposable toothbrush for use in cleaning interproximally between the teeth after they are brushed. The pouch, toothbrush, and dental floss preferably are fabricated of biodegradable material such that the entire kit can be disposed of safely after a user's teeth have been cleaned thoroughly therewith.

One aspect of this invention contemplates a sealed brush pod assembly that is manufactured independently of the sheath and that, during fabrication of the furlable brush, is bonded as a unit to the end portion of the sheath. The brush pod assembly comprises a semiflexible pad formed of latex or other suitable material. A bed of bristles or other abrasive material is bonded to or formed as a part of the latex pad and protrudes upwardly therefrom. The perimeter of the bristle bed is spaced from the edge of the latex pad to expose a rim of the pad around the bristles. A plastic cover is sized and configured to be placed over and cover the bristle bed and be removably affixed and sealed about the rim of the latex pad. In this way, the cover not only protects the bristles, it seals them off against bacteria and against the escape of moisture from the bristles. Therefore, the bristles can be impregnated with a moistened teeth cleaning gel, which is protected against drying out for long periods of time. The plastic cover is provided with a tab that can be conveniently grasped by a user to peal the cover away, exposing the impregnated bristles for use. Preferably, the cover is contoured about its periphery so that length of dental floss can be wrapped and secured around the cover for convenient storage.

Thus, it is an object of this invention to provide a disposable teeth cleaning kit that is sanitary, compact, and inexpensive to produce and purchase.

Another object of the invention is to provide a disposable finger mounted toothbrush that can be furled into an extremely compact configuration for storage and unfurled easily and quickly onto a finger for use.

A further object of the invention is to provide a teeth cleaning kit that includes means both for brushing the exposed clinical crown of one's teeth as well as cleaning interproximally between the teeth.

An additional object of the invention is to provide a method of cleaning the teeth that can be implemented conveniently and easily while traveling, hiking, at work, at school, or at play.

A still further object of the invention is to provide a disposable toothbrush that, when furled, protects the brush and bristles against compressive forces.

Another object of the invention is to provide a disposable toothbrush wherein the brush and its dentifrice are maintained in a sterile condition prior to use.

An additional object of the invention is to provide a sealed sterile pod unit that can be bonded to the end of a furlable sheath to form a brush having the advantages hereafter discussed.

These and other objects, features, and advantages of the present invention will become clearer and more apparent upon review of the detailed description set forth below when taken in conjunction with the following illustrative drawings.

DETAILED DESCRIPTION OF THE PREFERRED EMBODIMENTS

Figure 1:
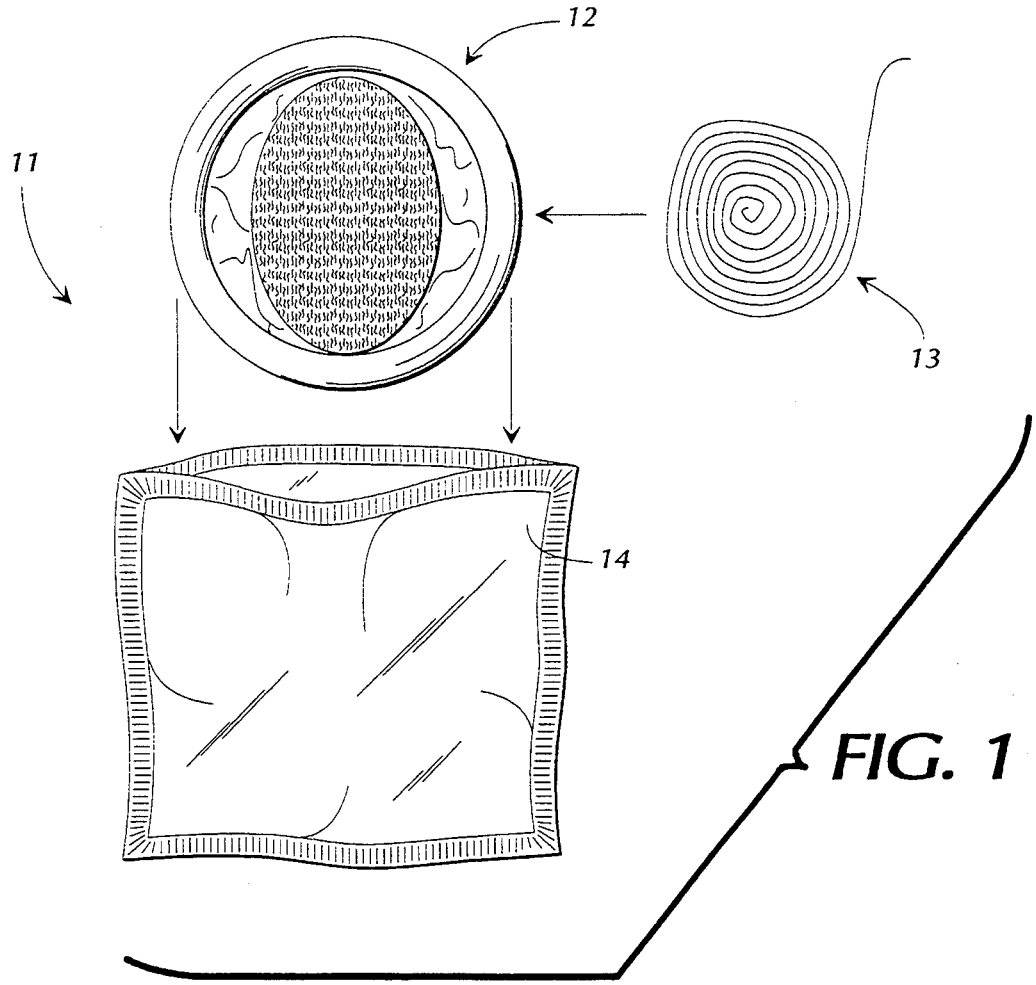
FIG. 1 is a front plan view illustrating a disposable teeth cleaning kit that embodies principals of the present invention in a preferred form.

Referring now in more detail to the drawings, in which like numerals represent like parts throughout the several views, FIG. 1 illustrates a teeth cleaning kit that embodies principals of the present invention in a preferred form. The kit 11 comprises a disposable finger mounted toothbrush 12, a coiled length of dental floss 13, and a sealable preferably foil storage pouch 14 for containing the toothbrush and dental floss and maintaining the sterile condition thereof prior to use. The pouch 14 is square or rectangular in shape and is sized to receive the toothbrush 12 and dental floss 13 in such a way that the entire package is substantially flat and easily storable in a purse, pocket, or backpack.

Figure 2:
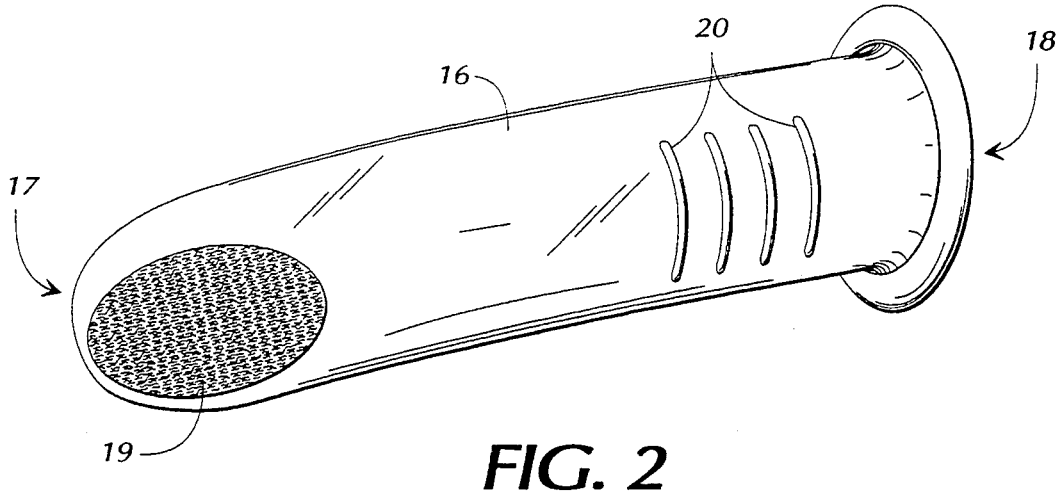
FIG. 2 is a perspective view of the disposable finger mounted toothbrush of this invention shown in its unfurled configuration for use in cleaning the teeth.

FIG. 2 is a perspective illustration showing the disposable toothbrush 12 of the kit 11 in its unfurled configuration for use in brushing the teeth. The toothbrush 12 is seen to comprise a substantially cylindrical elongated sheath 16 that has a closed end portion 17 and an open end portion 18. The sheath 16 preferably is formed of an elastic or elastomeric material such as latex rubber. However, many other types of appropriate materials might also be used with comparable results. It is desirable, however, that the material from which the sheath 16 is fabricated be biodegradable such that when the toothbrush is disposed in a landfill or the like, it will decompose naturally into elements that are not harmful to the environment. Ridges 20 are provided adjacent the open end portion of the sheath and are positioned to be pinched between the user's thumb and the base of the finger if necessary to prevent any slippage of the sheath on the finger as the toothbrush is used.

Brush means 19 is disposed adjacent the closed end portion 17 of the sheath 16 and extends generally from the tip of the sheath, around the closed end portion, and partially down the side thereof. The brush means 19 is conveniently configured to clean the teeth of a user when applied thereto with a brushing motion. In this regard, any of a number of configurations of the brush means might be employed with substantially the same result. For example, the brush means 19 might comprise a multitude of small bristles that extend outwardly from the closed end portion of the sheath 16. These bristles might be formed as an integral part of the sheath 16 during the manufacture thereof such that the bristles and the sheath are all fabricated from the same unitary piece of material. In the alternative, the bristles might extend outwardly from a small oval shaped pad that is adhesively bonded to the closed end portion of the sheath after the sheath itself is manufactured. Also, the brush means 19 might not be bristles at all but, instead, might comprise a small abrasive pad that would function to clean a user's teeth as efficiently as the bristles of a brush. In the case of a bristled or abrasive pad, the pad preferably would be manufactured separately, impregnated with a dentifrice such as a tooth gel, and covered with a removable tab to contain and protect the gel prior to use. The pad assembly could then simply be bonded to the end of the sheath to form the completed toothbrush. Other configurations of the brush means 19 might also be employed and it will be understood that the term "brush means" when used in the specification and claims of this patent encompasses and incorporates any such alternative means for cleaning the teeth when applied with a brushing motion thereto.

Figure 3:
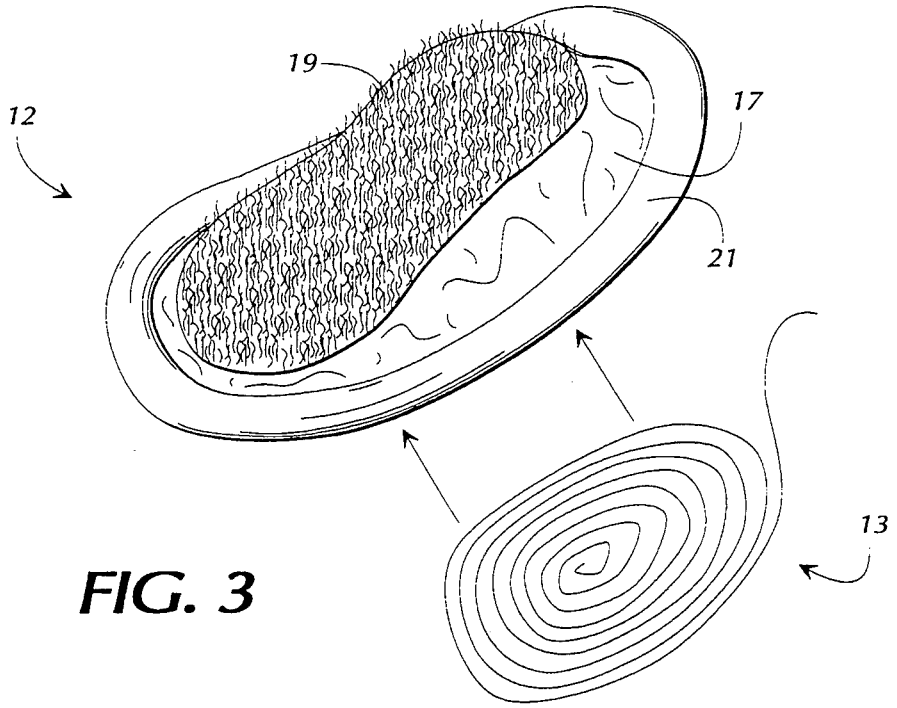
FIG. 3 is a perspective illustration showing the disposable finger mounted toothbrush of FIG. 2 in its compact furled storage configuration and indicating the storage position of a length of dental floss with respect to the toothbrush.

FIG. 3 illustrates the disposable finger mounted toothbrush 12 in its furled compact storage configuration; the configuration in which it is stored in the pouch 14 (FIG. 1). In the configuration shown in FIG. 3, the sheath 16 of the toothbrush 12 is seen to be furled or rolled up from its open end portion 18 toward its closed end portion 17. In this configuration, the furled portion of the sheath forms a substantially annular rim 21 with the area enclosed by the rim being spanned by the material of the closed end portion 17 of the sheath. When in this configuration, the brush means 19, which is located adjacent the closed end portion 17, also becomes disposed within the area bounded by the rim 21. Since the brush means 19 typically is thinner than the rim 21, it becomes generally bounded by the rim such that the entire toothbrush, when furled as shown in FIG. 3, takes on an extremely compact configuration with a thickness substantially equal to the thickness of the rim 21. In addition, a coiled length of dental floss 13 will fit neatly within the area bounded by the rim such that the furled toothbrush and dental floss, when sealed within the pouch 14, all form a substantially flat compact kit that fits easily in a purse or pocket and that can be carried by virtually anyone to virtually any place.

Figure 4A:
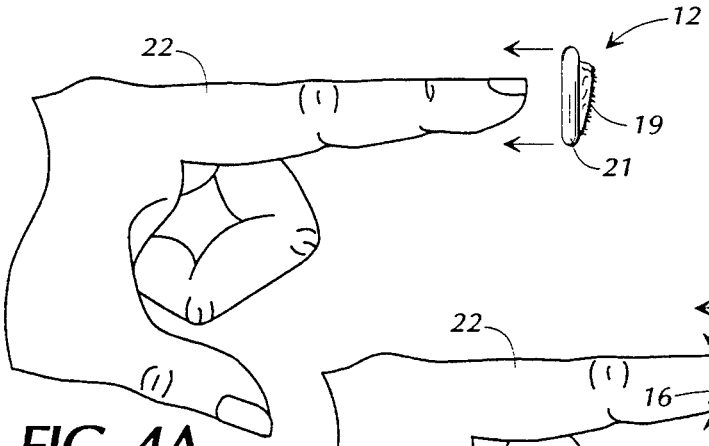
FIGS. 4A–4C illustrate how the toothbrush of this invention is progressively unfurled onto the finger of a user for use in brushing the teeth.
Figure 4B:
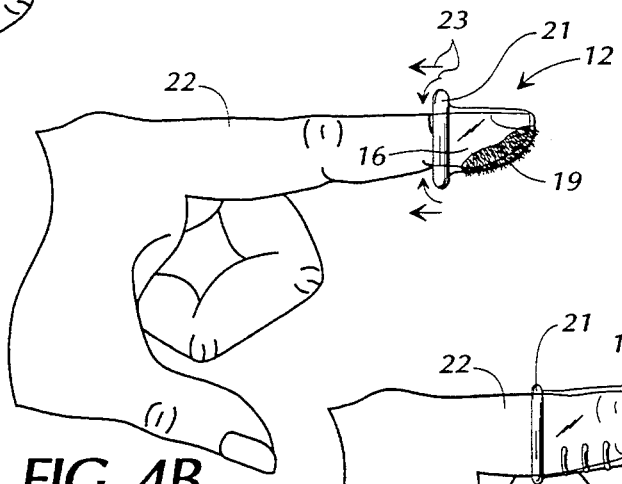
Figure 4C:
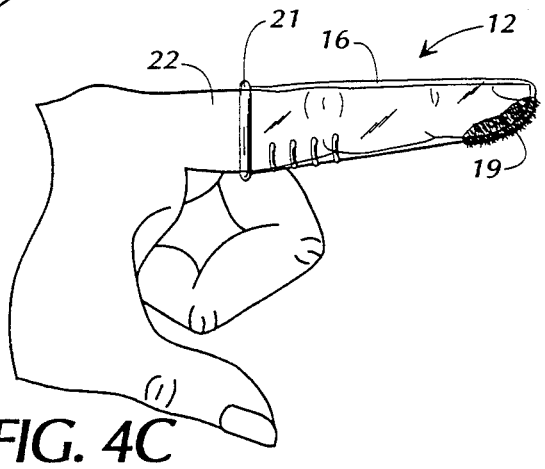

FIGS. 4A–4C illustrate how the disposable toothbrush 12 of the present invention is progressively unfurled onto a user's finger for brushing or cleaning the teeth. In FIG. 4A the toothbrush 12 with brush means 19 is seen to be in its furled storage configuration as if it had just been removed from its sealed pouch 14. While still in this configuration, the toothbrush 12 is moved toward the tip of the user's finger 22 as indicated by the arrows in FIG. 4A until the furled rim 21 of the brush receives and surrounds the tip of the finger. At this point (FIG. 4B), the furled rim 21 is progressively unfurled onto the user's finger as illustrated by the arrows 23. The unfurling continues progressively until the sheath 16 fits snugly about the user's finger with its closed end portion positioned adjacent the tip of the finger and its open end portion positioned adjacent the base of the finger as shown in FIG. 4C. With the brush 12 unfurled onto the user's finger in this way, the brush means 19 becomes securely positioned adjacent the tip of the user's finger extending partially down the inside face of the finger. In the event that the brush means is covered with a removable protective cover as disclosed above, the cover can be peeled away once the sheath is fully mounted on the finger. The brush can then be applied easily to the user's teeth by appropriate manipulation of the fingertip across the surfaces of the teeth. In the event that further stability is needed, the user can simply place his thumb on the ridges 20 of the sheath 16 and hold the thumb firmly against the base of his finger as the teeth are brushed.

Figure 5:
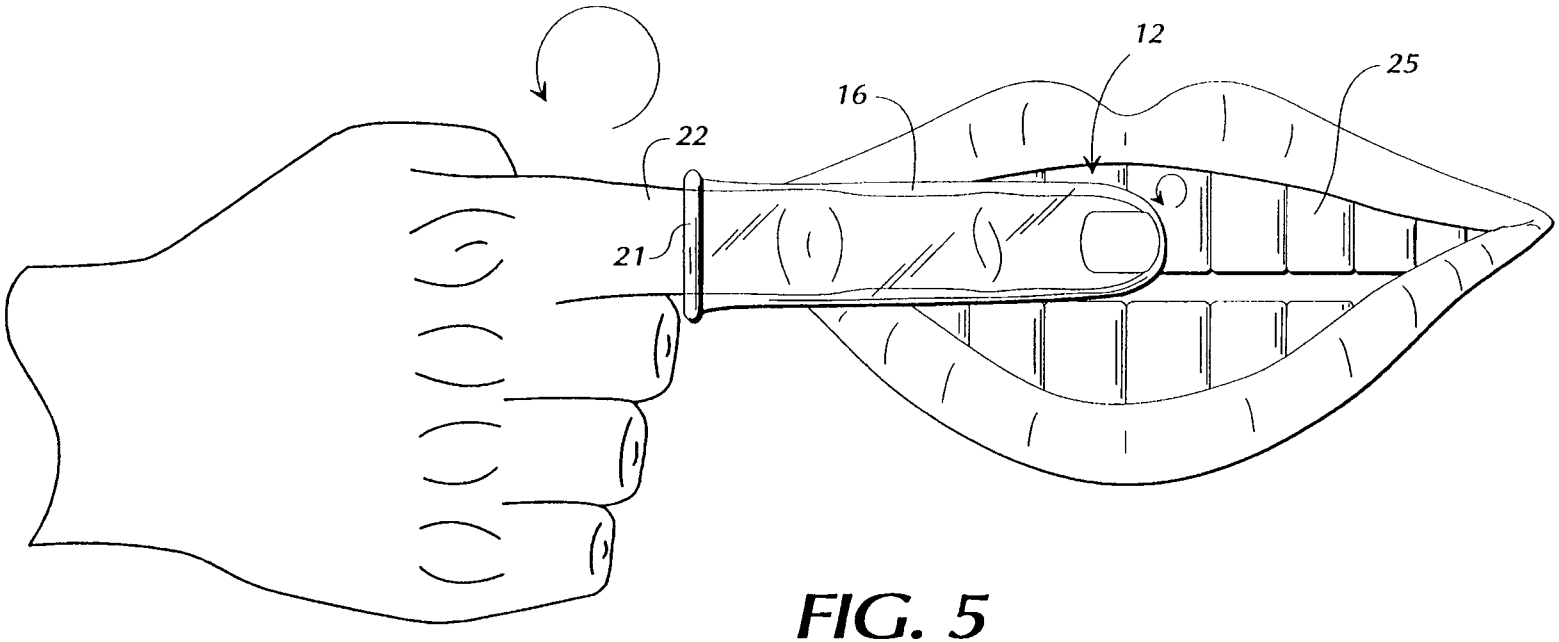
FIG. 5 illustrates use of the toothbrush shown in FIG. 2 for cleaning the exterior portion of one's teeth.
Figure 6:
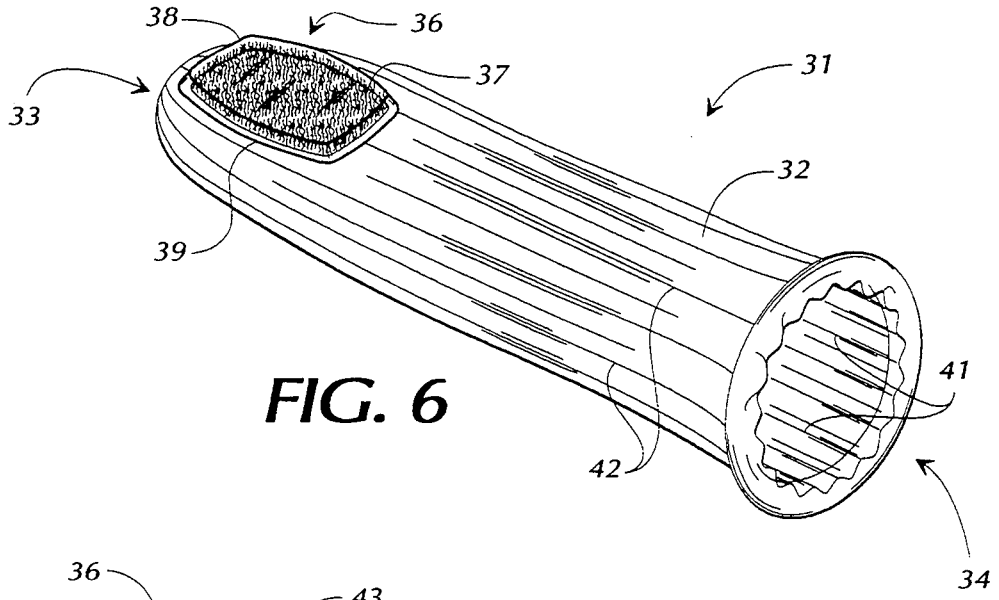
FIGS. 6–8 illustrate an alternate embodiment of the invention wherein the sheath is provided with longitudinal torque ridges and the brush is protected by a sealed sterile cover or pod.

FIG. 5 illustrates the disposable toothbrush 12 of the present invention unfurled onto a user's finger 22 and being used to clean the user's teeth 25. More specifically, once the brush 12 is unfurled onto the finger, the fingertip and thus the brush 19 is applied to the surface of the teeth and the finger 22 is appropriately manipulated to move the brush means 19 across the surfaces of the teeth in a brushing motion. As this is done, the dentifrice that is impregnated into the brush means 19 is moistened by the user's saliva, which activates the dentifrice causing it to foam and aid in the cleaning of the user's teeth.

When the teeth have been sufficiently cleaned, the toothbrush 12 is simply unfurled from the user's finger by reversing the process shown in FIG. 4A–4C and discarded in a suitable refuse receptacle. The user can then apply the dental floss 13 to clean interproximally between his teeth whereupon the dental floss and the sealed pouch in which the floss and toothbrush were stored are all discarded.

An added advantage of the present invention when cleaning one's teeth is that the finger is totally encased and protected by the sheath 16 so that it is not exposed to the gel or other dentifrice or to the saliva within the mouth. Accordingly, when the toothbrush 12 is removed from the finger, the finger is clean and dry and unaffected by the brushing process.

FIGS. 6–9 illustrate an alternate preferred embodiment of the present invention. In this embodiment, the sheath of the toothbrush is provided with longitudinally extending torque ridges and the brush itself is sealed and protected within a sterile cover or pod. More particularly, the brush 31 is seen to comprise an elongated furlable sheath 32 having a closed end 33 and an open end 34. As with the previous embodiment, the sheath 32 is sized and adapted to be furled into a compact storage configuration and to be unfurled on a user's index finger for use.

The closed end 33 of the sheath 32 is provided with a brush assembly 36, which actually cleans the teeth during use. The brush assembly 36 comprises a multitude of closely spaced outwardly extending bristles 37. The bristles 37 can be formed as an integral part of the sheath 32 if desired. However, for this embodiment it is desired that the bristles extend outwardly from a base pad 44 (FIG. 9) that, in turn, is fixed to the end of the sheath 32 by any appropriate means such as electrostatic bonding, melting, adhesive and the like.

A flexible cover 38 is disposed about and covers the bristles 37 of the brush. The cover 38 is removably sealed about its lower perimeter 39 to the sheath or, preferably, to the perimeter of the base pad 44 from which the bristles 37 extend. Thus, the base pad 44, bristles 37, and cover 38 form an integral unit that can be manufactured separately in sterile conditions and fixed to the sheath with appropriate adhesive.

The sheath 32 is molded or otherwise formed to have longitudinally extending torque ridges 41 that are located at least on the interior surface of the sheath 32. Torque ridges 42 can also be formed on the exterior surface of the sheath if desired. When the sheath 32 is unfurled onto the finger of a user for use, the torque ridges 41 engage the finger along its length and prevent the sheath from slipping or rotating on the finger as the toothbrush 31 is used to clean the teeth. In addition, the user can grasp the exterior torque ridges 42 with the thumb thereby pinching them between the thumb and the finger on which the sheath is rolled. This tends to stabilize the brush further for use and also helps to prevent rolling of the sheath on the finger.

Figure 7:
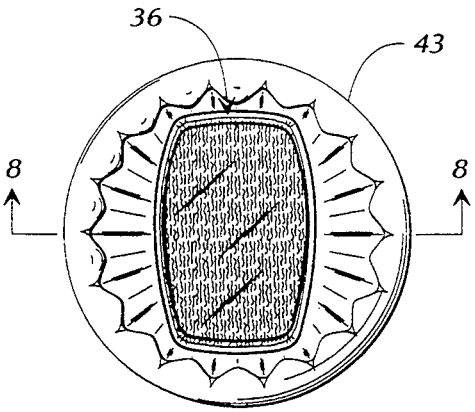
Figure 8:
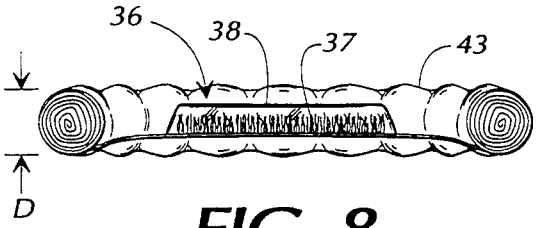

As illustrated in FIGS. 7 and 8, the sheath of this embodiment is adapted to be rolled or furled upwardly toward the brush assembly 36 thus forming an annular peripheral rim 43. As shown in FIG. 8, the rim 43 has a diameter "D", which is a function of the thickness of the latex material, the length of the sheath 32, and the size of the torque ridges.

The brush assembly 36 is sized and located on the sheath 32 so that when the sheath is fully furled, the brush assembly can be positioned within the furled rim such that the rim 43 surrounds the entire brush assembly 36 as best seen in FIG. 7. Furthermore, as illustrated in FIG. 8, the thickness of the brush assembly 36 is less than the thickness D of the furled rim 43. It will thus be appreciated that when the brush 31 is furled into its compact storage configuration, the brush assembly 36 becomes surrounded and protected by the furled annular rim 43 against compressive forces that might otherwise crush or flatten the bristles of the brush. These bristles are further protected by the cover 38 of the sealed sterile pod. Thus, when furled, the integrity of the bristles as well as any dentifrice that might be pre-impregnated therein is insured by the relative configurations and sizes of the brush assembly and the furled rim. This is a significant aspect of this invention since it is intended to be stored in a foil pouch that might be placed for long periods of time in a pocket, purse, backpack, or other location where significant compressive forces could otherwise smash and deform the bristles of the brush.

Figure 9:
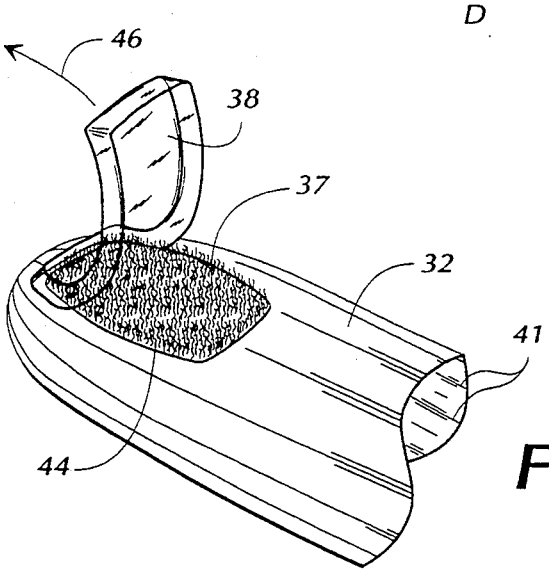
FIG. 9 is a partially cut away perspective view of the closed end of the brush showing one method of pealing away the protective cover of the sealed pod.

FIG. 9 illustrates removal of the cover 38 that forms the sealed sterile pod prior to use of the toothbrush 31. As mentioned above, the cover 38 is removably sealed about its lower edges to the pad 44 from which the bristles 37 extend. For manufacturing purposes, this configuration is desirable since the pad 44, bristles 37, and cover 38 form a unitary element that can be premanufactured and adhered to the sheath 32 during manufacture of the toothbrush 31. Once the toothbrush 31 is furled onto a user's finger, the soft plastic cover 38 is simply grasped between the fingers and peeled away as indicated by the arrow 46. The cover 38 can then be discarded or, if desired, can be saved or deposited for recycling. Alternatively, the cover 38 might be formed of a soft organic gel type material such as that used to produce the casings of medicinal capsules. In this way, the cover would be biodegradable and could simply be discarded without fear of endangering the environment.

Once the cover 38 is peeled away as shown, the brush 31 is applied to the teeth as described above to clean the teeth, whereupon the entire toothbrush can be disposed of in an appropriate manner.

Figure 10:
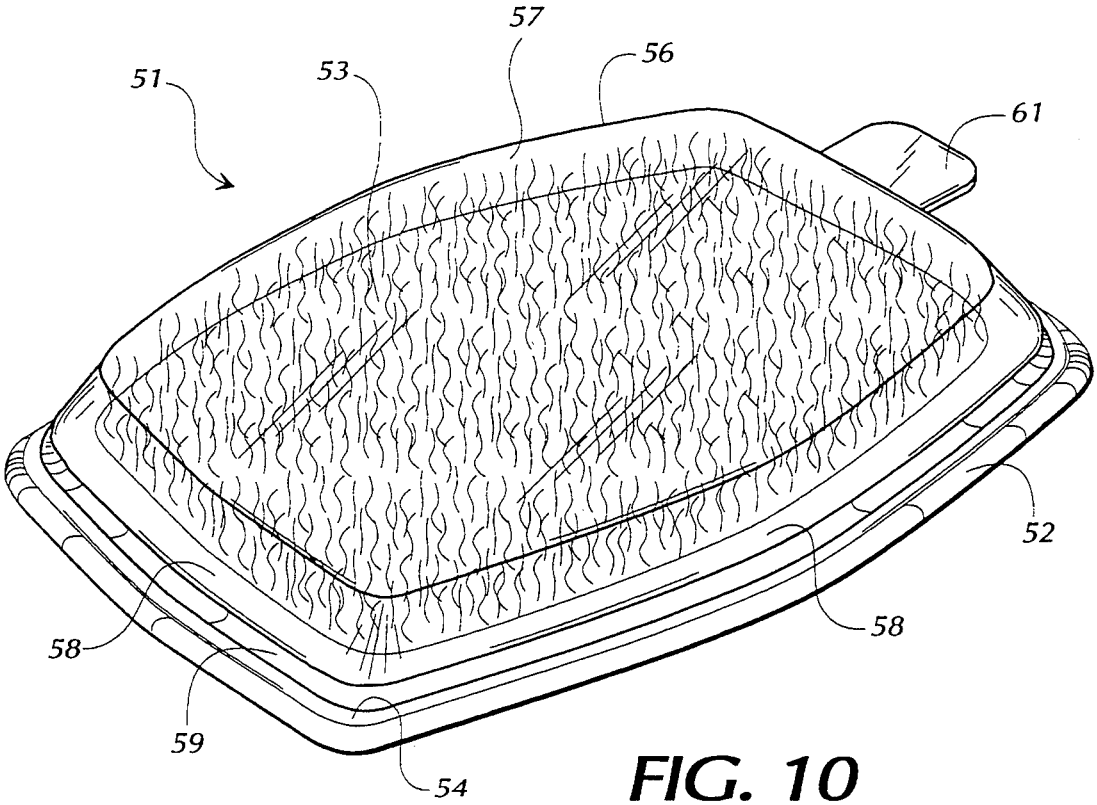
FIG. 10 is a perspective view of a sterile sealed brush pod for use in fabricating the brush of this invention.
Figure 11:
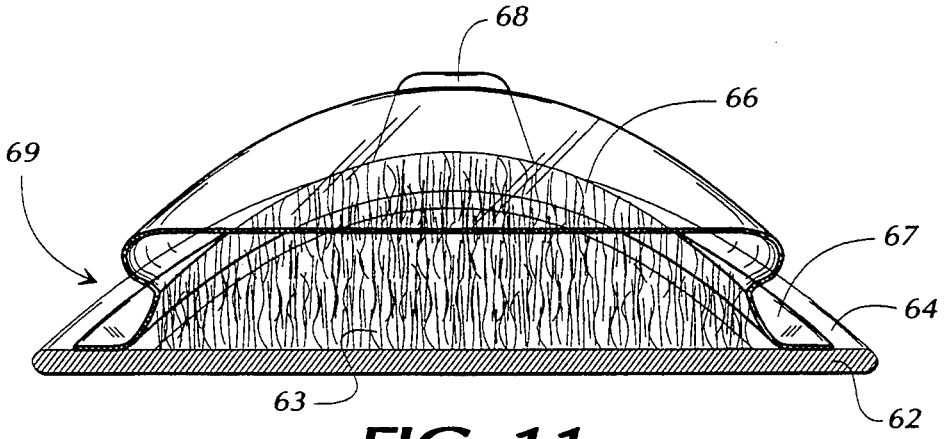
FIG. 11 is a cross-sectional view of a sterile sealed brush pod of one preferred embodiment wherein the protective cover is contoured to receive a coiled length of dental floss.

FIGS. 10 and 11 illustrate two preferred embodiments of a sterile sealed brush pod unit for use in fabricating a brush of this invention. In FIG. 10, the unit 51 comprises a flexible latex pad 52 that supports a bed of upstanding bristles 53. As discussed above, the bristles 53 can take any of a number of possible forms including upstanding individual bristles that are formed of the same material as the latex pad 52; an abrasive pad; or bristles that are separately adhered to the flexible pad 52. In addition, the pad 52, while preferably formed of latex for its semiflexible characteristics, can be formed from any of a number of possible substitute materials that also exhibit flexibility and bondability to a furlable sheath.

The perimeter of the bristled bed 53 is spaced from the outside edge of the pad 52 to define a lip 54 that extends around the pod unit. A protective cover 56 has a top portion 57 bounded by depending sides 58. The sides 58 terminate at their lower extent in an outwardly extending rim 59 that extends around the protective cover 56. The protective cover 56 preferably is formed of a vacuum molded thin plastic material and preferably is clear to reveal the brushes beneath. Alternatively, the protective cover 57 can be molded of a gelatin material so that when discarded, the protective cover simply dissolves naturally with no adverse environmental impact. One end of the protective cover 57 is provided with a projecting tab 61 that can be grasped between a users fingers for removing the protective cover from the brush bed.

The lip 59 of the protective cover 57 is removably sealed about the rim 54 of the latex pad 52. In sealing the protective cover to the pad it is preferable that a biological adhesive such as a gum or gelatin be used since the brushes of this invention are to be placed in the mouth of the user. In addition, the bristle bed 53 preferably is impregnated with a gelled toothpaste that foams and helps clean the teeth of the user when the brush is applied thereto.

The sealed protective cover 57 serves a number of functions in the pod unit of FIG. 10. Specifically, since the cover is sealed about the entire perimeter of the brush bed, the bristles and gel therein are protected against infection by bacteria or viruses in the air. Accordingly, the cover forms a sterile pod to prevent infection. Also, the cover can help protect the brush bed against compressive forces that might deform the bristles or squeeze the gel out of the brush bed. Finally, the protective cover 57 seals in moisture such that a moistened gel rather than a dried dentifrice can be impregnated into the bristles. A moistened gel is desirable over a dried dentifrice because of its fast action and easy application during the fabrication process.

During fabrication of a furlable sheath of the present invention, the sterile pod unit of FIG. 10 is manufactured in advance as shown and simply adhered to the end of the furlable sheath to create the brush. Such an adhesion process can easily implemented during fabrication by bringing the pod unit together with the sheath with an appropriate adhesive applied therebetween. When ready for use, then, the sheath is simply unfurled onto the finger as previously discussed whereupon the tab 61 is grasped and the protective cover 57 pealed away to reveal the brush and gel thereunder.

FIG. 11 shows, in section, an alternate embodiment of the pod unit of this invention wherein the protective cover is contoured to receive and hold a coiled length of dental floss around its perimeter. The pod unit of FIG. 11 comprises a flexible latex pad 62 bearing a brush bed 63 and having a peripheral lip 64. A protective cover 66 covers the brush bed 63 and has a peripheral rim 67 that is sealed about the lip 64 of the pad 62. As with the previous embodiment, a tab 68 is provided on one end of the protective cover to allow the cover to be pealed away from the brush pad for use.

In the embodiment of FIG. 11, the depending sides of the protective cover 66 are contoured inwardly as best shown at 69 forming a grooved chime around the perimeter of the cover. This chime is sized and configured to receive and hold a coiled length of dental floss. With this embodiment, the dental floss is simply stored by being coiled around the chime of the protective cover. When the cover is removed for use, the dental floss can simply be uncoiled and used after the brush has been applied to the teeth. In this way, the fabrication process is simplified since the sealed sterile pod and dental floss assembly can be manufactured in advance and simply applied adhesively to a furlable sheath to create the brush. In addition, the combination of the protective cover with the coiled dental floss saves space and is efficient for storing the furl device in a pouch.

The invention has been described above in terms of preferred embodiments and methodologies. It will be obvious to those of skill in this art, however, that various improvements, additions, and deletions might well be made to the illustrated embodiments within the scope of this invention. For example, as previously mentioned, any of a number of appropriate brush means might be used effectively adjacent the closed end portion of the sheath to clean or abrade materials from a user's teeth. In addition, means other than dental floss for cleaning interproximally between the teeth, such as a small wooden pick or the like, might be used with comparable results and should be considered equivalent to the illustrated dental floss. These and other modifications might well be made to the embodiments illustrated herein without departing from the spirit and scope of the invention as set forth in the claims.

I claim:

1. A sealed pod for application to a furlable sheath to create a disposable toothbrush, said pod comprising:

a flexible base pad having a periphery, a top surface, and a bottom surface;

a bed of brush material on said top surface of said base pad with said bed of brush material having a perimeter that is spaced inwardly from the periphery of said flexible base pad to define a lip portion of said top surface of said pad surrounding said brush bed;

said bottom surface of said base pad being exposed for adhesive attachment to a furlable sheath;

a protective cover having a top and depending sides, said protective cover being positioned on said top surface of said flexible base pad to cover said bed of brush material and being releasably sealed to said base pad top surface about the lip portion thereof;

said depending sides of said protective cover being contoured for receiving and holding a coiled length of dental floss;

and a coiled length of dental floss disposed about said depending sides of said protective cover.

2. A sealed pod as claimed in claim 1 and wherein said brush bed comprises a plurality of bristles extending upwardly from said base pad.

3. A sealed pod as claimed in claim 1 and wherein said brush bed comprises an abrasive pad.

4. A sealed pod as claimed in claim 1 and wherein said base pad is formed of latex.

5. A sealed pod as claimed in claim 1 and further comprising a tab projecting from said protective cover and being positioned to be grasped between the fingers of a user for peeling the pad away from the brush bed.

6. A sealed pod as claimed in claim 1 and wherein said depending sides of said protective cover are inwardly contoured to define a grooved chime around the perimeter of said protective cover, said chime for receiving and holding a coiled length of dental floss for storage.

7. A sealed pod as claimed in claim 6 and further comprising a projecting rim extending outwardly about the lower extent of said depending sides, said rim being removably bonded and sealed about said lip of said top surface of said flexible base pad.

8. A sealed pod as claimed in claim 1 and further comprising a dentifrice impregnated into said brush pad for aiding the cleaning of the teeth during use of said pod.

9. A sealed pod as claimed in claim 8 and wherein said dentifrice comprises a dental gel.

10. A sealed pod for application to a furlable sheath to create a disposable finger mounted toothbrush, said pod comprising a flexible pad from which a bed of brush material upwardly extends, a protective cover positioned to cover and protect said bed of brush material with said protective cover being releasably sealed about its perimeter to said flexible pad to seal off said bed of brush material and protect it against contamination and dehydration, means on said protective cover for facilitating selective manual removal of the cover from the pad prior to use, and a coiled length of dental floss wrapped about the perimeter of said protective cover for storage.

11. A sealed pod as claimed in claim 10 and wherein the perimeter of said protective cover is inwardly contoured to form a grooved chime for receiving and holding said coiled length of dental floss during storage of said pod.

12. A sealed brush pod for application to a furlable finger cot that, when furled, defines a substantially annular peripheral rim having a predetermined diameter, said sealed brush pod comprising a flexible base pad having a periphery and having a maximum extent that is less than the predetermined diameter of the peripheral rim of a finger cot to which said brush pod is to be applied, a bed of brush material on said base pad with said bed having a perimeter spaced inwardly from the periphery of said base pad to define a lip portion of said base pad surrounding said bed of brush material, and a protective cover having a top and depending side shaped in the form of an annular groove, a coiled length of dental floss disposed about said protective cover in said annular groove, said protective cover being positioned on said base pad to cover said bed of brush material and being releasably sealed to said base pad about the lip portion thereof.

* * * * *